US012330073B2

(12) United States Patent
Che

(10) Patent No.: US 12,330,073 B2
(45) **Date of Patent: *Jun. 17, 2025**

(54) MOVABLE PUZZLE PLATFORM

(71) Applicant: Xiaoling Che, Hubei (CN)

(72) Inventor: Xiaoling Che, Hubei (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/956,131

(22) Filed: Nov. 22, 2024

(65) Prior Publication Data

US 2025/0083031 A1 Mar. 13, 2025

Related U.S. Application Data

(63) Continuation of application No. 18/732,602, filed on Jun. 3, 2024, now Pat. No. 12,186,676, which is a continuation of application No. 18/541,685, filed on Dec. 15, 2023, now Pat. No. 12,042,740, which is a continuation of application No. 17/505,587, filed on Oct. 19, 2021, now Pat. No. 11,890,551.

(30) Foreign Application Priority Data

Sep. 26, 2021 (CN) ..... 202111131554.1
Sep. 26, 2021 (CN) ..... 202122334815.1

(51) Int. Cl.

| | |
|---|---|
| ***A63F 9/10*** | (2006.01) |
| ***A47B 13/08*** | (2006.01) |
| ***A47B 41/00*** | (2006.01) |
| ***A47B 41/02*** | (2006.01) |
| ***A47B 83/04*** | (2006.01) |

(52) U.S. Cl.
CPC ..... *A63F 9/1044* (2013.01); *A47B 13/081* (2013.01); *A47B 13/083* (2013.01); *A47B 13/088* (2013.01); *A47B 41/00* (2013.01); *A47B 41/02* (2013.01); *A47B 83/045* (2013.01); *A63F 2009/105* (2013.01)

(58) Field of Classification Search
CPC .. A63F 9/1044; A63F 2009/105; A47B 13/08; A47B 13/081; A47B 13/083; A47B 41/02
See application file for complete search history.

(56) References Cited

U.S. PATENT DOCUMENTS 4,591,161 A * 5/1986 Vanderhoof ..... A63F 3/0423 273/272
4,659,050 A * 4/1987 Tabayashi ..... F16C 33/588 248/349.1

(Continued)

*Primary Examiner* — Daniel J Rohrhoff

(57) ABSTRACT

A movable puzzle platform includes a puzzle board having a top surface and a board accessible unit having a first moving member, a second moving member, and a first bearing unit coupled between the first moving member and the second moving member. A first circumferential surface of the first moving member is engaged with a second circumferential surface of the second moving member via the first bearing unit to enable the second moving member to be coaxially rotated with respect to the first moving member. The first moving member includes a first horizontal flat base and a first rolling surface arranged along the first horizontal flat base. Therefore, a player is able to move the puzzle board on the playing surface at a desired orientation to assemble the puzzle pieces on the top surface of the puzzle board.

20 Claims, 7 Drawing Sheets

(56) References Cited

U.S. PATENT DOCUMENTS

| | | | | |
|---|---|---|---|---|
| 4,865,325 | A * | 9/1989 | Stolz | A63F 9/1044 273/157 R |
| 7,273,212 | B1 * | 9/2007 | Kolbaba | A47B 25/00 108/103 |
| 11,388,990 | B1 * | 7/2022 | Watkins | A63F 9/1044 |
| 11,890,551 | B2 * | 2/2024 | Che | A47B 41/00 |
| 12,083,443 | B1 * | 9/2024 | Ihley-Fortuna | F16M 11/046 |
| 2007/0039523 | A1 * | 2/2007 | Helzer | A47B 13/083 108/27 |
| 2010/0101461 | A1 * | 4/2010 | Brault | A47B 13/003 108/140 |
| 2021/0170268 | A1 * | 6/2021 | Malki | A63F 9/1044 |
| 2022/0025925 | A1 * | 1/2022 | An | F16C 33/583 |
| 2023/0347235 | A1 * | 11/2023 | Zhou | A47B 88/906 |
| 2023/0356070 | A1 * | 11/2023 | Che | A63F 9/1044 |
| 2023/0390632 | A1 * | 12/2023 | Che | F16M 11/08 |
| 2024/0325874 | A1 * | 10/2024 | Che | A47B 9/20 |
| 2024/0335736 | A1 * | 10/2024 | Che | F16M 11/08 |

* cited by examiner

MOVABLE PUZZLE PLATFORM

CROSS REFERENCES AND PRIORITIES

This application is a continuation of U.S. patent application Ser. No. 18/732,602, filed on Jun. 3, 2024. The U.S. patent application Ser. No. 18/732,602 is a continuation of U.S. patent application Ser. No. 18/541,685 filed on Dec. 15, 2023, which is a continuation of U.S. patent application Ser. No. 17/505,587 filed on Oct. 19, 2021 which claims the benefit of Chinese Patent Application Nos. 2021111315541 and 2021223348151 filed on Sep. 26, 2021, the contents of each of which are incorporated by reference in their entirety.

BACKGROUND OF THE PRESENT INVENTION

Field of Invention

The present invention relates to puzzle game apparatus, and more particularly to a movable puzzle platform, wherein the puzzle platform is movable with respect to one or more players for allowing the player to move the puzzle platform for placing the puzzle pieces thereon at different planar directions, such that the player does not need to physically travel from side to side of the puzzle platform.

Description of Related Arts

Puzzles are devised over the years and are among the most popular board games generally played alone by an individual. It is well known that puzzles are good for the brain. Studies have shown that playing puzzles can improve cognition and visual-spatial reasoning, and can train concentration and patience.

Other than as a means of entertainment and enjoyment, players would like to challenge themselves by playing higher piece counts of the puzzle. Generally speaking, the higher the piece count, the harder the puzzle is. However, a common drawback or a burden for the player is that the finished size of the puzzles is relatively large. For example, a finished size of 1,000 piece puzzles is about 30"×24", a finished size of 5,000 piece puzzles is about 60"×40", and so on. In other words, these puzzles require a relatively large playing surface such as the surface of a table or a puzzle board for putting all the pieces together to form a puzzle figure. Therefore, to play a relatively large puzzle, for example 60"×40" or more, the side length of the puzzle board is longer than the player's arm length that the player is unable to reach the other sides of the puzzle board, so that the player is required to move around the playing surface to put pieces at different directions and portions near each side of the puzzle board. As a skilled player, the strategies for playing the puzzles are configured for sorting the pieces into groups and assembling the border first. Therefore, the player will need to move from one side of the playing surface to another side thereof to play the puzzles. Furthermore, it could take hours, days or even months to compete a larger scale puzzle. One or more puzzle pieces could be missed accidentally or unintentionally. It is sad that the player usually finds out there is a missing piece at the end. Therefore, how to avoid losing any pieces, it is best to find a container to save all the unfinished pieces.

A need exists for a tool that retains all the unfinished pieces and while allowing the player to conveniently player the puzzle. It is to the provision of such a tool that the present disclosure is primarily directed.

SUMMARY OF THE PRESENT INVENTION

The present disclosure provides a movable puzzle platform for placing a plurality of puzzle pieces thereon. The movable puzzle platform comprises: a puzzle board and a board accessible unit. The puzzle board includes a top surface for playing the puzzle pieces thereon, at least one drawer cavity formed at a sidewall of the puzzle board and at least one section puzzle board slidably received in a corresponding drawer cavity. The board accessible unit includes a first moving member, a second moving member, and a first bearing unit coupled between the first moving member and the second moving member, wherein the first moving member is rotatably mounted to the second moving member by the first bearing unit. An outer circumferential surface of the first moving member is engaged with an inner circumferential surface of the second moving member via the first bearing unit to enable the second moving member to be coaxially rotated with respect to the first moving member. The first moving member comprises a first horizontal flat base and a first rolling surface arranged along the first horizontal flat base. The first horizontal flat base comprises a first overlapping portion overlapped with the first bearing unit in a thickness direction of the board accessible unit, and an outer surface of the first overlapping portion has a substantially flat shape.

The present disclosure further provides a movable puzzle platform for placing a plurality of puzzle pieces thereon. The movable puzzle platform includes a puzzle board and a board accessible unit. The puzzle board includes a top surface for playing the puzzle pieces thereon, a bottom surface opposite the top surface and a supplement arrangement. The board accessible unit includes a first moving member, a second moving member, and a first bearing unit coupled between the first moving member and the second moving member, wherein the first moving member is rotatably mounted to the second moving member by the first bearing unit. The first moving member has a first circumferential surface and the second moving member has a second circumferential surface opposite to the first circumferential surface. The first circumferential surface of the first moving member is engaged with the second circumferential surface of the second moving member via the first bearing unit to enable the second moving member to be coaxially rotated with respect to the first moving member. The first moving member comprises a first horizontal flat base and a first rolling surface arranged along the first horizontal flat base. The first horizontal flat base comprises a first overlapping portion overlapped with the first bearing unit in a thickness direction of the board accessible unit, and an outer surface of the first overlapping portion has a substantially flat shape. The supplement arrangement comprises one or more drawer cavities formed at sidewalls of the puzzle board between the top surface and the bottom surface and comprises one or more section puzzle boards slidably received in the drawer cavities.

The present disclosure further provides a movable puzzle platform for placing a plurality of puzzle pieces thereon. The movable puzzle platform includes: a puzzle board and a board accessible unit. The puzzle board includes a top surface for playing the puzzle pieces thereon, a bottom surface opposite the top surface and a supplement arrangement. The board accessible unit includes a first moving member, a second moving member, and a first bearing unit coupled between the first moving member and the second moving member, wherein the first moving member is rotatably mounted to the second moving member by the first bearing unit. The first moving member comprises a first horizontal flat base and a first rolling surface arranged along the first horizontal flat base. The first horizontal flat base comprises a first overlapping portion overlapped with the first bearing unit in a thickness direction of the board accessible unit, and an outer surface of the first overlapping portion has a substantially flat shape. The weight of the puzzle board is applied directly to the first bearing unit through the first moving member along a thickness direction of the board accessible unit. The supplement arrangement comprises one or more drawer cavities formed at sidewalls of the puzzle board between the top surface and the bottom surface and comprises one or more section puzzle boards slidably received in the drawer cavities.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
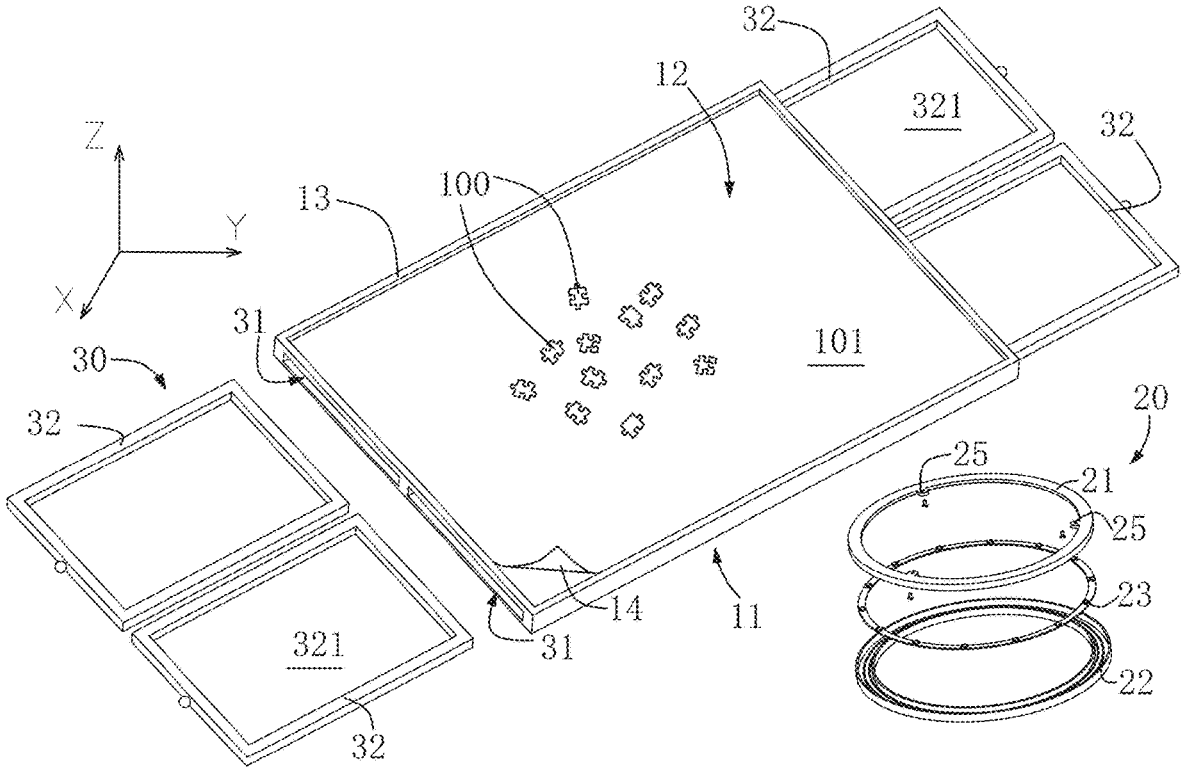
FIG. 1 is an exploded perspective view of a movable puzzle platform according to a preferred embodiment of the present invention.
Figure 2:
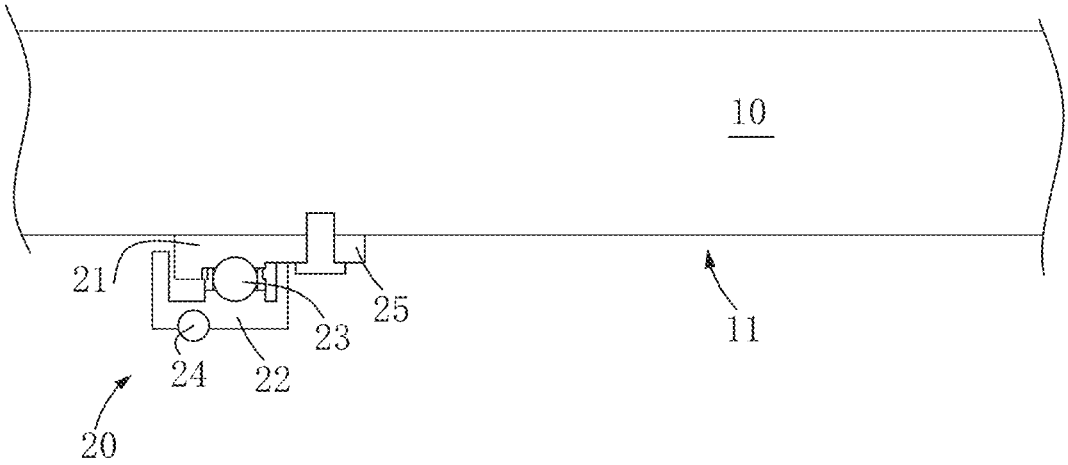
FIG. 2 is a side view of a board accessible unit of the movable puzzle platform according to the above preferred embodiment of the present invention.

Referring to FIGS. 1 and 2, a movable puzzle platform according to a preferred embodiment of the present invention is illustrated, wherein the movable puzzle platform is arranged for a user or a player to assemble a plurality of puzzle pieces 100 on a puzzle surface of the movable puzzle platform. Accordingly, the movable puzzle platform comprises a puzzle board 10 and a board accessible unit 20.

As shown in FIGS. 1 and 2, the puzzle board 10, having a panel configuration, has a bottom 11 for supporting on a playing surface such as a table surface, a wall surface, a floor surface, and the like or even a support frame for supporting the movable puzzle platform on ground, and provides a top surface 12, wherein when the top surface 12 is a flat surface, it serves as a puzzle floor 101 for playing the puzzle pieces 100 thereon. It is worth mentioning that the puzzle board 10 has a predetermined size adapted for a larger scale puzzle, such as at least 1,000 puzzle pieces, being assembled on the puzzle board 10.

The board accessible unit 20 is coupled at the bottom surface 11 of the puzzle board 10 and configured for allowing the puzzle board 10 sliding on the playing surface, wherein the board accessible unit 20 provides accessibility for the puzzle board 10 to move the puzzle board 10 at different planar directions with respect to the playing surface.

The puzzle board 10 can be circular, square or rectangular shape. According to the preferred embodiment as shown in FIG. 1, the puzzle board 10 is embodied to have a rectangular shape defining two longer longitudinal sides and two shorter transverse sides. The puzzle board 10 further comprises a surrounding border wall 13 upwardly extended from a peripheral edge of the top surface 12 of the puzzle board 10 to define the puzzle floor 101 within the surrounding border wall 13. It is worth mentioning that an area of the puzzle floor 101 is not smaller than an area of the puzzle pieces 100 being put together. Preferably, the area of the puzzle floor 101 matches with the area of the puzzle pieces 100 after the puzzle pieces 100 are assembled. In other words, the puzzle board 10 serves as a puzzle frame for framing the puzzle pieces 101 after the puzzle pieces 100 are assembled.

As shown in FIG. 1, the puzzle board 10 further comprises an anti-slipping layer 14 overlappedly provided on the puzzle floor 101 for preventing the puzzle pieces 100 being slipped thereon. Preferably, the anti-slipping layer 14 has a self adhesive bottom surface adhered on the puzzle floor 101, wherein the anti-slipping layer 14 can be removed from the puzzle floor 101 without damaging the puzzle floor 101 and the anti-slipping layer 14. Therefore, the anti-slipping layer 14 is reusable to place on the puzzle floor 101. Furthermore, the anti-slipping layer 14 serves as a backing layer of the puzzle pieces 100 after the puzzle pieces 100 are assembled.

It is appreciated that electronic puzzle game is provided as software or APP that the user or player can play the puzzle game with a display such as a TV screen, LED screen or computer monitor. However, the player may generally use a smaller screen to play because a relatively larger screen such as 50" or more TV screen supported on a playing surface is difficult for the player to reach all sizes of the screen. In one alternative embodiment, the puzzle board 10 can be embodied as an electronic screen, such as a TV display or LED screen, and the top surface 12 is the screen surface that serves as puzzle floor for the player to select and put puzzle piece images together, wherein the board accessible unit 20 is mounted to the bottom of the electronic puzzle board 10 for allowing the electronic puzzle board 10 to smoothly slide on the playing surface that provides accessibility for moving the electronic puzzle board 10 at different planar directions with respect to the playing surface.

As shown in FIGS. 1 and 2, the board accessible unit 20 comprises a first moving member 21 coupled at the bottom 11 of the puzzle board 10 and a second moving member 22 rotatably coupled to the first moving member 21. It is worth mentioning that the board accessible unit 20 is preferred to be coupled coaxially with a center of gravity of the puzzle board 10, for example at a center portion of the puzzle board 10, such that the puzzle board 10 can be moved on the playing surface in a balancing manner.

According to the preferred embodiment of the present invention, the puzzle board 10 is adapted for being self-rotated 360° on the playing surface via a rotation movement between the first and second moving members 21, 22. In other words, the user is able to selectively rotate the puzzle board 10 from one longitudinal side to another opposed longitudinal side or to any one of the shorter transverse sides without walking around the puzzle board 10. For example, the user is able to assemble one puzzle piece 100 at one side of the puzzle board 10 and to rotate the puzzle board 10 at 180° in order to assembly another puzzle piece 100 at an opposed side of the puzzle board 10, so as to speed up the assembling time of the puzzle pieces 100.

In one embodiment, the first and second moving members 21, 22 are first and second ring members respectively coaxially engaged with each other. In other words, a diabase 40*er* of the first moving member 21 is smaller than a diabase 40*er* of the second moving member 22. The board accessible unit 20 comprises further comprises a first bearing unit 23 coupled between the first and second moving members 21, 22, such that when the first moving member 21, i.e. the first ring member, is rotated within the second moving member 22, i.e. the second ring member, the puzzle board 10 is self-rotated 360° on the playing surface. Particularly, an outer circumferential surface of the first moving member 21 is engaged with an inner circumferential surface of the second moving member 22 via the first bearing unit 23 to enable the second moving member 22 being coaxially rotated with respect to the first moving member 21. In one embodiment, the first bearing unit 23 is constructed to have a holding ring and a plurality of ball bearings spacedly retained at the holding ring in a rotatable manner, such that when the holding ring is coaxially held between the first and second moving members 21, 22, the ball bearings are rotatably sandwiched between the first and second moving members 21, 22 so as to enable the first and second moving members 21, 22 being coaxially moved with each other.

The board accessible unit 20 further comprises a second bearing unit 24 provided at a bottom side of the second moving member 22 for sliding the puzzle board 10 on the playing surface at different planar directions via the second moving member 22. Accordingly, assumed that the playing surface defines xyz axis. Via the second bearing unit 24 at the second moving member 22, the puzzle board 10 is able to selectively slide on the playing surface at any direction with respect to the xy coordinate surface. Via the first bearing unit 23, the puzzle board 10 is able to selectively rotate on the playing surface with respect to z axis. In other words, the puzzle board 10 is able to freely move at two-dimensional direction, so as to adjust the planer angle of the puzzle board 10 with respect to the user. The first moving member 21 comprises a first flat base 211 and a first rolling surface 212 arranged along the first flat base 211. The first rolling surface 212 is curved towards the first flat base 211. The first bearing unit 23 is partly overlapped with the first flat base 211 in a thickness direction of the board accessible unit 20. The second moving member 22 comprises a second flat base 213 and a protrusion 214 protruded from the second flat base 213 toward the first moving member 21 for engaging with the first bearing unit 23, a recess 215 extending from the second flat base 213 towards the first moving member 21 for dividing the second flat base 213 into a first part 216 and a second part 217. The area of the first part 216 is substantially greater that of the second part 217. The first bearing unit 23 is partly overlapped with the first part 216 of the second flat base 213.

Figure 3:
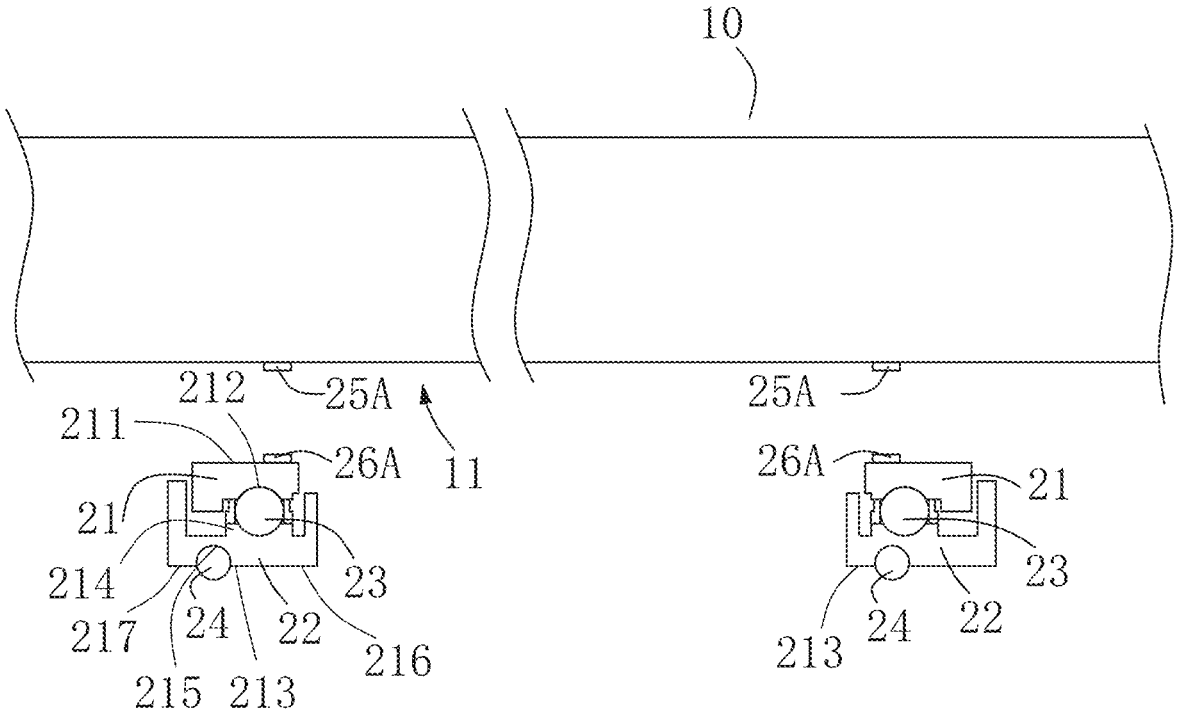
FIG. 3 illustrates an alternative mode of the board accessible unit of the movable puzzle platform according to the above preferred embodiment of the present invention.
Figure 3A:
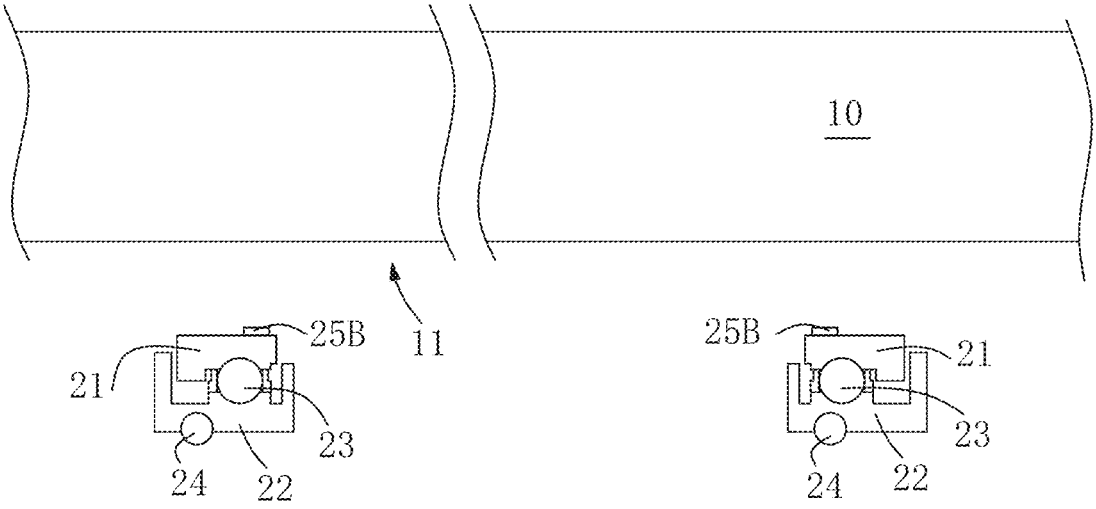
FIG. 3A illustrates another alternative mode of the board accessible unit of the movable puzzle platform according to the above preferred embodiment of the present invention.

In one embodiment, the board accessible unit 20 is detachably coupled at the bottom surface 11 of the puzzle board 10. As shown in FIGS. 2, 3 and 3A, the board accessible unit 20 comprises a plurality of coupling members 25 extended from the first moving member 21 to detachably couple at the bottom surface 11 of the puzzle board 10. Preferably, the coupling members 25 are integrally extended from an inner circumferential surface of the first ring member, i.e. the first moving member 21, wherein each of the coupling members 25 has a coupling slot formed thereon to detachably couple at the bottom surface 11 of the puzzle board 10 by inserting screws through the coupling slot to the bottom surface 11 of the puzzle board 10. It is worth mentioning that a plurality of screw holes are formed at the bottom surface 11 of the puzzle board 10, such that the screws can engage with the screw holes through the coupling slot to couple the board accessible unit 20 at the bottom surface 11 of the puzzle board 10.

Alternatively, as shown in FIG. 3, the board accessible unit 20 further comprises one or more first coupling elements 25A spacedly provided on the bottom surface 11 of the puzzle board 10, and one or more second coupling elements 26A spacedly provided at the first moving member 21 to detachably couple the first coupling elements 25A so as to detachably couple the board accessible unit 20 at the bottom surface 11 of the puzzle board 10. Preferably, the first and second coupling elements 25A, 26A are magnetic elements adapted for magnetically attracting with each other. The first coupling elements 25A are aligned in a ring shaped on the bottom surface 11 of the puzzle board 10. The second coupling elements 26A are provided on a top surface of the first ring member, i.e. the first moving member 21, wherein the first and second coupling elements 25A, 26A are aligned with each other and are magnetically attracted with each other to detachably couple the board accessible unit 20 at the bottom surface 11 of the puzzle board 10.

Alternatively, as shown in FIG. 3A, the board accessible unit 20 further comprises one or more coupling elements 25B provided on at least one of the bottom surface 11 of the puzzle board 10 and the first moving member 21 to detachably couple the board accessible unit 20 at the bottom surface 11 of the puzzle board 10. In one embodiment, the coupling element 25B is a self-adhering film or a self-sticking film provided on the first moving member 21 to detachably adhere on the bottom surface 11 of the puzzle board 10. It is worth mentioning that the coupling element 25B has a ring shape matching with the first moving member 21, wherein the coupling element 25B is re-usable to detachably adhere on the bottom surface 11 of the puzzle board 10 without damaging the detachably adhere on the bottom surface 11 of the puzzle board 10. It is appreciated that the coupling element 25B can be applied on the bottom surface 11 of the puzzle board 10 to detachably adhere to the first moving member 21.

Figure 4:
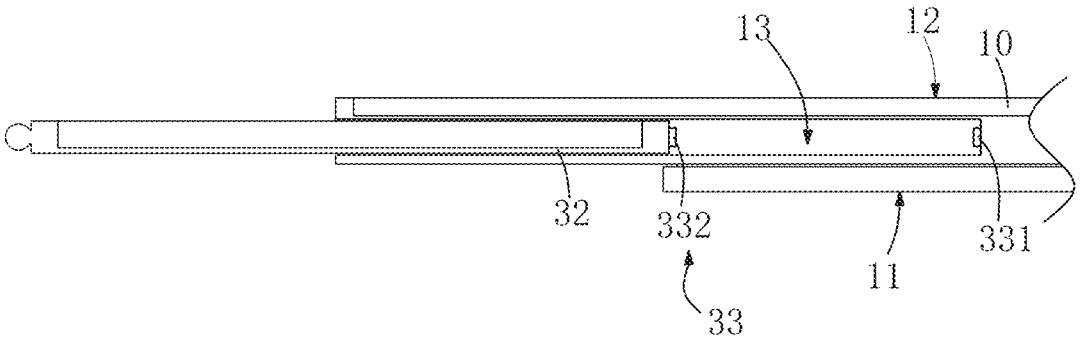
FIG. 4 is a sectional view of a supplement arrangement of the movable puzzle platform according to the above preferred embodiment of the present invention.

As shown in FIGS. 1 and 4, the movable puzzle platform further comprises a supplement arrangement 30 configured not only for storing the puzzle pieces 100 before they are assembled, but also for allowing the player to preassemble and store a section of the puzzle figure with a group of puzzle pieces 100. In one embodiment, the supplement arrangement 30 has one or more drawer cavities 31 formed at sidewalls of the puzzle board 10 between the bottom surface 11 and the top surface 12 thereof and comprises one or more section puzzle boards 32 slidably received in the drawer cavities 31 respectively. According to the preferred embodiment of the present invention, each of the section puzzle boards 32, which is embodied as a puzzle drawer 32, has a section puzzle surface with an anti-slipping layer 14 attached thereon to serve as section puzzle floor 321 for preassembling a group of puzzle pieces 100 to form a section of the puzzle figure and storing the puzzle pieces 100.

According to the preferred embodiment, the drawer cavities 31 are formed at the transverse sides of the puzzle board 10 respectively. Particularly, two drawer cavities 31 are spacedly formed at each of the transverse sides of the puzzle board 10. In other words, two puzzle drawers 32 are slidably coupled at each of the transverse sides of the puzzle board 10. Therefore, four puzzle drawers 32 are slidably coupled at the transverse sides of the puzzle board 10. It is worth mentioning that each puzzle drawer 32 is independently actuated to slide in-and-out of the corresponding drawer cavity 31. Since the puzzle drawers 32 are slidably coupled at the transverse sides of the puzzle board 10, each puzzle drawer 32 is relatively long enough and each drawer cavity 31 is deep enough to retain the puzzle drawer 32 therein so as to prevent the puzzle drawer 32 being slid out of the drawer cavity 31 accidentally or unintentionally when moving the puzzle board 10 on the playing surface. Accordingly, a length of each puzzle drawer is slightly smaller than half of the length of the puzzle board 10 between the transverse sides thereof.

The supplement arrangement 30 further comprises a drawer holder 33 provided at the puzzle board 10 to retain the puzzle drawers 32 in the drawer cavities 31 respectively. In one embodiment, the drawer holder 33 comprises a first magnetic element 331 provided at an inner wall of the drawer cavity 31 and a second magnetic element 332 provided at the puzzle drawer 32 to magnetically attract with the first magnetic element 331 so as to retain the puzzle drawer 32 in the drawer cavity 31. Due to the magnetically attracting force between the first and second magnetic elements 331, 332, the puzzle drawers 32 are held within the drawer cavities 31 respectively to prevent the puzzle drawer 32 being slid out of the drawer cavity 31 accidentally or unintentionally when moving the puzzle board 10 on the playing surface. When a pulling force is applied at one of the puzzle drawers 32 to overcome the magnetically attracting force, the puzzle drawer 32 can be pulled and slid out of the drawer cavity 31.

Figure 5:
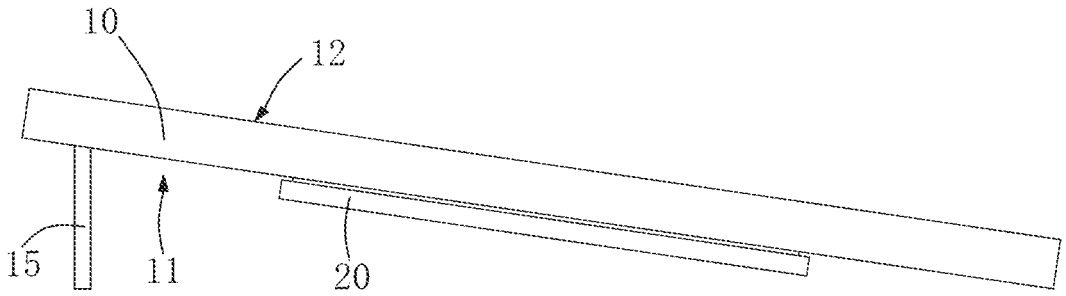
FIG. 5 is a side view of the movable puzzle platform according to the above preferred embodiment of the present invention, illustrating a kickstand being pivotally folded to support the puzzle board at an inclined manner on the playing surface.

As shown in FIG. 5, the puzzle board 10 further comprises a kickstand 15 pivotally coupled at the bottom surface 11 of the puzzle board 10. Particularly, one end of the kickstand 15 is pivotally coupled at the bottom surface 11 of the puzzle board 10 while a free end of the kickstand 15 is adapted to pivotally fold from the puzzle board 10 to support on the playing surface. Therefore, when the kickstand 15 is pivotally folded on the bottom surface 11 of the puzzle board 10, the puzzle board 10 is movable on the playing surface via the board accessible unit 20. When the kickstand 15 is pivotally folded for supporting on the playing surface, the puzzle board 10 is inclined and supported on the playing surface.

Figure 6:
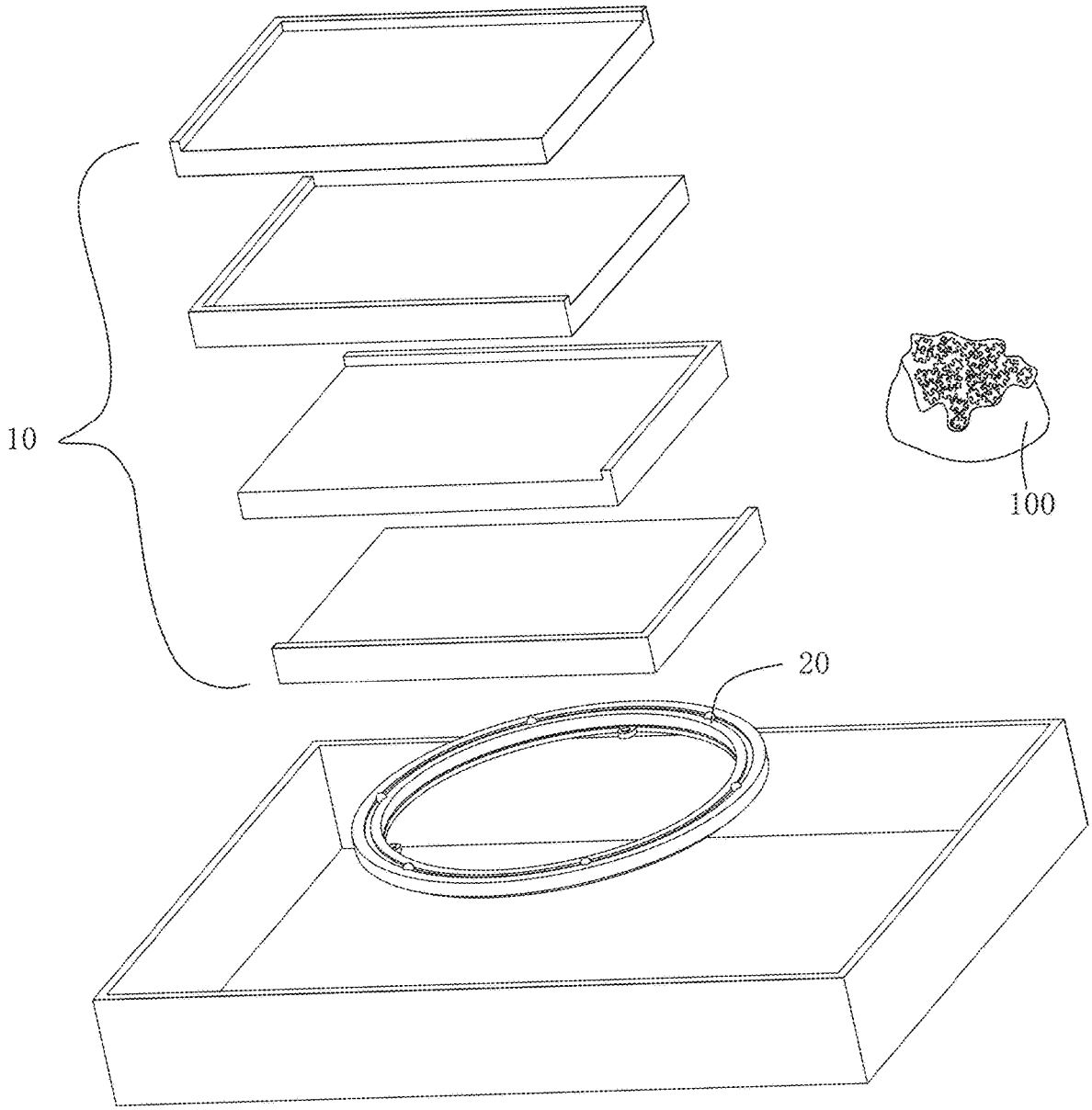
FIG. 6 is a perspective view of the movable puzzle platform incorporating with the puzzle pieces to form a puzzle game kit according to the above preferred embodiment of the present invention.

In one application, as shown in FIG. 6, the movable puzzle platform of the present invention can be incorporated with the puzzle pieces 100 to form a puzzle game kit. Particularly, the area of the puzzle floor 101 matches with the area of the puzzle pieces 100 after the puzzle pieces 100 are assembled, such that the puzzle board 10 serves as a puzzle frame for framing the puzzle pieces 101 after the puzzle pieces 100 are assembled. Furthermore, the puzzle board 10 is constructed to have a plurality of board panels. Therefore, the board panels, the board accessible unit 20 and the puzzle pieces 100 are packed in a box. In order to play the puzzle pieces 100, the board panels can be assembled edge-to-edge to form the puzzle board 10. Then, the board accessible unit 20 can be coupled at the bottom side 11 of the puzzle board 10 to form the movable puzzle platform for the user to move the puzzle board 10 on the playing surface and to assemble the puzzle pieces 100 on the top surface 12 of the puzzle board 10. Once the puzzle pieces 100 are completely assembled on the top surface 12 of the puzzle board 10, the board accessible unit 20 can be detached from the bottom side 11 of the puzzle board 10, such that the puzzle board 10 forms the puzzle frame for framing the puzzle pieces 100.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A movable puzzle platform for placing a plurality of puzzle pieces thereon, comprising:

a puzzle board comprising a top surface for playing the puzzle pieces thereon, at least one drawer cavity formed at a sidewall of the puzzle board and at least one section puzzle board slidably received in a corresponding drawer cavity; and a board accessible unit comprising a first moving member, a second moving member, and a first bearing unit coupled between the first moving member and the second moving member, wherein the first moving member is rotatably mounted to the second moving member by the first bearing unit;

wherein an outer circumferential surface of the first moving member is engaged with an inner circumferential surface of the second moving member via the first bearing unit to enable the second moving member to be coaxially rotated with respect to the first moving member;

wherein the first moving member comprises a first horizontal flat base and a first rolling surface arranged along the first horizontal flat base; and wherein the first horizontal flat base comprises a first overlapping portion overlapped with the first bearing unit in a thickness direction of the board accessible unit, and an outer surface of the first overlapping portion has a substantially flat shape.

2. The movable puzzle platform, as recited in claim 1, wherein the weight of the puzzle board applies directly to the first bearing unit through the first horizontal flat base of the first moving member along a thickness direction of the board accessible unit, the first bearing unit comprises a plurality of ball bearings spaced apart and retained between the first rolling surface of the first moving member and the second moving member, and the center of gravity of each ball bearing passes directly through the first overlapping portion of the first horizontal flat base.

3. The movable puzzle platform, as recited in claim 1, wherein the weight of the puzzle board applies directly to the second moving member through the first horizontal flat base of the first moving member and the first bearing unit along a thickness direction of the board accessible unit.

4. The movable puzzle platform, as recited in claim 1, wherein the first rolling surface is curved towards the first horizontal flat base.

5. The movable puzzle platform, as recited in claim 1, wherein the second moving member comprises a second horizontal flat base, the second horizontal flat base comprises a second overlapping portion overlapped with the first bearing unit in a thickness direction of the board accessible unit, and an outer surface of the second overlapping portion has a substantially flat shape.

6. The movable puzzle platform, as recited in claim 5, wherein the second moving member further comprises a protrusion protruded from the second horizontal flat base toward the first moving member along the thickness direction of the board accessible unit for engaging with the first bearing unit.

7. The movable puzzle platform, as recited in claim 5, wherein the second moving member further comprises a recess extending from the second horizontal flat base towards the first moving member for dividing the second horizontal flat base into a first part and a second part, an outer surface of the first part has a substantially flat shape and an outer surface of the second part has a substantially flat shape.

8. The movable puzzle platform, as recited in claim 7, wherein a width of the first part is substantially greater than a diameter of the first bearing unit, and the first bearing unit is partially overlapped with the first part of the second horizontal flat base.

9. The movable puzzle platform, as recited in claim 1, wherein the first moving member is coupled with the puzzle board.

10. The movable puzzle platform, as recited in claim 1, wherein the second moving member is coupled with the puzzle board.

11. The movable puzzle platform, as recited in claim 1, wherein a diameter of the first moving member is substantially smaller than a diameter of the second moving member.

12. A movable puzzle platform for placing a plurality of puzzle pieces thereon, comprising:

a puzzle board comprising a top surface for playing the puzzle pieces thereon, a bottom surface opposite the top surface and a supplement arrangement; and a board accessible unit comprising a first moving member, a second moving member, and a first bearing unit coupled between the first moving member and the second moving member, wherein the first moving member is rotatably mounted to the second moving member by the first bearing unit;

wherein the first moving member has a first circumferential surface and the second moving member has a second circumferential surface opposite to the first circumferential surface;

wherein the first circumferential surface of the first moving member is engaged with the second circumferential surface of the second moving member via the first bearing unit to enable the second moving member to be coaxially rotated with respect to the first moving member;

wherein the first moving member comprises a first horizontal flat base and a first rolling surface arranged along the first horizontal flat base;

wherein the first horizontal flat base comprises a first overlapping portion overlapped with the first bearing unit in a thickness direction of the board accessible unit, and an outer surface of the first overlapping portion has a substantially flat shape; and wherein the supplement arrangement comprises one or more drawer cavities formed at sidewalls of the puzzle board between the top surface and the bottom surface and comprises one or more section puzzle boards slidably received in the drawer cavities.

13. The movable puzzle platform, as recited in claim 12, wherein the second moving member comprises a second flat base having a second overlapping portion overlapped with the first bearing unit in a thickness direction of the board accessible unit, and an outer surface of the second overlapping portion has a substantially flat shape.

14. The movable puzzle platform, as recited in claim 13, wherein the second moving member further comprises a recess extending from the second flat base towards the first moving member for dividing the second flat base into a first part and a second part.

15. The movable puzzle platform, as recited in claim 12, wherein the weight of the puzzle board is applied directly to the first bearing unit through the first flat base of the first moving member along a thickness direction of the board accessible unit.

16. The movable puzzle platform, as recited in claim 12, wherein the puzzle board has a rectangular shape defining two longer longitudinal sides and two shorter transverse sides, wherein two of the drawer cavities are spacedly formed at each of the transverse sides of the puzzle board, such that four of the puzzle drawers are slidably coupled at the transverse sides of the puzzle board.

17. A movable puzzle platform for placing a plurality of puzzle pieces thereon, comprising:

a puzzle board comprising a top surface for playing the puzzle pieces thereon, a bottom surface opposite the top surface and a supplement arrangement; and a board accessible unit comprising a first moving member, a second moving member, and a first bearing unit coupled between the first moving member and the second moving member, wherein the first moving member is rotatably mounted to the second moving member by the first bearing unit;

wherein the first moving member comprises a first horizontal flat base and a first rolling surface arranged along the first horizontal flat base;

wherein the first horizontal flat base comprises a first overlapping portion overlapped with the first bearing unit in a thickness direction of the board accessible unit, and an outer surface of the first overlapping portion has a substantially flat shape;

wherein the weight of the puzzle board is applied directly to the first bearing unit through the first moving member along a thickness direction of the board accessible unit; and wherein the supplement arrangement comprises one or more drawer cavities formed at sidewalls of the puzzle board between the top surface and the bottom surface and comprises one or more section puzzle boards slidably received in the drawer cavities.

18. The movable puzzle platform, as recited in claim 17, wherein the second moving member comprises a second horizontal flat base and a recess extending from the second horizontal flat base towards the first moving member for dividing the second horizontal flat base into a first part and a second part, and an outer surface of the first part has a substantially flat shape and an outer surface of the second part has a substantially flat shape.

19. The movable puzzle platform, as recited in claim 18, wherein the area of the first part is substantially greater than that of the second part, and the first bearing unit is partially overlapped with the first part of the second horizontal flat base.

20. The movable puzzle platform, as recited in claim 17, wherein the puzzle board has a rectangular shape defining two longer longitudinal sides and two shorter transverse sides, wherein two of the drawer cavities are spacedly formed at each of the transverse sides of the puzzle board, such that four of the puzzle drawers are slidably coupled at the transverse sides of the puzzle board.

* * * * *